US008011771B2

(12) United States Patent
Wazana et al.

(10) Patent No.: US 8,011,771 B2
(45) Date of Patent: Sep. 6, 2011

(54) REMANUFACTURED INKJET PRINTER CARTRIDGE, SYSTEM AND PROCESS

(75) Inventors: Yoel Wazana, Chatsworth, CA (US); Sagie Shanun, Sherman Oaks, CA (US); Joda Paulus, Chatsworth, CA (US)

(73) Assignee: Wazana Brothers International, Inc., Van Nuys, CA (US)

( * ) Notice: Subject to any disclaimer, the term of this patent is extended or adjusted under 35 U.S.C. 154(b) by 387 days.

(21) Appl. No.: 12/368,959

(22) Filed: Feb. 10, 2009

(65) Prior Publication Data

US 2009/0201349 A1 Aug. 13, 2009

Related U.S. Application Data

(60) Provisional application No. 61/027,754, filed on Feb. 11, 2008.

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | | |
|---|---|---|---|---|
| 6,773,087 | B2 * | 8/2004 | Wazana et al. | 347/22 |
| 7,399,052 | B1 | 7/2008 | Anderson et al. | |
| 2004/0066429 | A1 | 4/2004 | Wazana et al. | |
| 2007/0002106 | A1 | 1/2007 | Wazana et al. | |

FOREIGN PATENT DOCUMENTS

EP 1078759 A 2/2001

* cited by examiner

*Primary Examiner* — An H Do

(57) ABSTRACT

Systems, methods and structures for remanufacturing inkjet printer cartridges and inkjet printer print heads by removing the print head and adhesive holding the print head to a used inkjet printer cartridge, preparing the cartridge housing for a new print head by routing out the used print head and used adhesive to create a new mounting surface for new adhesive and a new print head, placing the adhesive and new print head on the new mounting surface, curing the adhesive and assembling a re-manufactured cartridge from the cartridge housing having a new print head positioned thereon.

16 Claims, 8 Drawing Sheets

REMANUFACTURED INKJET PRINTER CARTRIDGE, SYSTEM AND PROCESS

CROSS REFERENCE TO RELATED APPLICATION

This application claims the benefit of U.S. provisional patent application 61/027,754, filed Feb. 11, 2008, which is incorporated by reference herein.

FIELD OF INVENTION

The presently described inventions relate to the field of inkjet printer cartridges and inkjet printer print heads, more specifically to remanufacturing, replacing and repairing inkjet cartridges.

BACKGROUND

Most common inkjet cartridge remanufacturing processes involve a number of typical steps and that take place in various stages.

Preparation Stage

Often times a used, typically empty cartridge is stored without any cover on the print head such as a clip or a tape for a prolonged period of time (months or sometimes years). As a result the used ink residues get dried in the firing chambers and between the filter and the print head and causes blockage of the ink path. In the preparation stage, the used cartridge is thoroughly washed and cleaned in order to remove as much as possible the dried original ink residues. The used cartridge is then dried to avoid dilution of water and dilution of new ink that later fills the remanufactured cartridge.

Also, during the preparation stage, on some occasions, depending on the model and type of cartridge, the cap is removed, and on some occasions the foam is removed, washed and dried or replaced by a new cap. On some occasions, depending on the cartridge model, the filter screen is removed and a new filter is welded on the ink delivery tunnel. It is believed that there is no remanufacturing process that involves removing the used print head assembly and installing a new print head assembly.

Filling Stage

In the filling stage the foam is put back into the cartridge, in case it was removed and the cartridge is filled with new ink. It is believed that there are two major filling techniques. First, in the no vacuum filling technique, a needle is inserted into the foam inside the cartridge and a pump or manually filling with a syringe is employed to dispense the ink. The second technique involves filling the cartridge under vacuum conditions. In this technique the cartridge is put inside a vacuum chamber that generates vacuum in order to assure that no air bubbles are trapped in the ink path. The trapped bubbles can block the ink path and cause local print failure. The ink is dispensed into the foam inside the cartridge while the cartridge is under vacuum conditions, and then the vacuum is slowly released, and the cartridge is then taken out of the chamber.

Printing Stage

In the printing stage the remanufactured cartridge's print quality is tested by placing the cartridge in a printer and printing a few sample pages in order to evaluate the quality of the print.

Packaging Stage

In the packaging stage the remanufactured cartridge is re-labeled, cleaned, sealed and boxed. The print head assembly in an inkjet printer cartridge is in charge of dispensing the ink directly on the printed media. The print head is a combination of microscopic dispensing chambers. Each chamber has an embedded resistor that is electrically connected to contacts on the print head assembly's flexible board. Upon receiving a signal from the printer, the resistor heats up for a predetermined period. The heating of the embedded resistor inside each chamber causes local boiling of the ink that is its surroundings, and the heating action creates an air bubble of water vapor that pushes the ink inside the chamber through a firing nozzle in the opposite direction of the resistor onto the printed media. The combination of thousands or millions of microscopic drops on the printed media creates the image.

There are several reasons that cause the print head assembly not to fire up or not to fire up effectively for an ink jet drop. One of the possible reasons for failure of the ink chamber is electrical discontinuity of the resistor from the flexible board at some point due to mechanical damage or excessive temperature cycles. Another possible failure is accumulation of dry ink over the resistor during the lifecycle of the cartridge or in storage that will disrupt the required heat exchange between the resistor and the ink in the chamber to generate the vapor bubble in a timely manner. Yet another possible reason for failure of the chamber would be mechanical damage such as scratch or a ding to the surface of the nozzle plate that prevents the ink bubble from flowing out of the ink chamber. Yet another possible reason for failure is the drying of ink inside the ink chamber that disrupts the delivery of ink from the main reservoir in the cartridge to the chamber. Yet another possible reason for failure is an original cartridge design deliberately made by the original manufacturer. In such designs the original circuit is designed to discharge a significant current from a capacitor into the print head circuitry once the cartridge is depleted, with sufficient current to thus burn or fuse the relatively delicate electrical conduits or traces in the print head and cause subsequent malfunction of the heat resistors, as described in U.S. Pat. No. 6,099,101. All of the above examples will produce one or more white lines across the printed media, often times called "streaking".

The vast majority of defects or problems with original or used cartridge that are used in an inkjet cartridge remanufacturing process can be traced to one or more of the above described examples. Thus, without replacing the print head assembly of a depleted, once used, inkjet cartridge a significant amount of failures cannot be avoided.

To address the above-described problems the present methods are directed to removing used print heads from a used, original inkjet cartridge and installing a new inkjet print head assembly over the used inkjet cartridge's container.

SUMMARY

Responding to the aforementioned needs and problems, described herein are processes for removing an original or used print head from a used inkjet printer cartridge, cleaning and preparing the original, used inkjet printer cartridge housing assembly and installing a new inkjet printer print-head assembly on the prior art inkjet cartridge housing assembly.

The original or used cap of the used cartridge is removed preferably by means of cutting, splitting or by pinching it out using pressure. The used foam that retains the ink is then removed, rewashed, dried or replaced. The used ink filter is removed.

The removal process applied to the used print head assembly requires affixing the used cartridge to a holding fixture that is preferably mounted on a CNC operated routing machine that, together with the use of pre-programmed computer software removes the used inkjet print head using a routing bit adapted to the dimensions of the specific cartridge being remanufactured. The routing machine routs new run-out tunnels for the new adhesive that is used to install the new print-head.

The used inkjet cartridge housing is then washed, preferably in a conveyor washing machine, or, alternatively, in any type of manual or automatic washing machine with water alone or mild detergents and water pressure.

The used cartridge housing is then dried, preferably using convection oven, conveyor oven or, alternatively, any other type of drying method, manual or automatic.

A new filter is then welded, preferably by ultrasonic or standard heat methods to the used cartridge housing. A new piece of foam or a used piece of foam that has been cleaned and dried is then installed on the cartridge. A new cap is installed or a used cap is then re-installed, preferably by means of ultrasonic welding.

A new inkjet print-head assembly in then installed in the previously and newly routed area. The new print head is installed, preferably according to the following steps.

Application of the Adhesive.

In this step the adhesive that is used to connect or to adhere the new print head to the used cartridge housing is preferably a commercially available epoxy amine or acrylic base, two-component adhesive. The adhesive is preferably dispensed using a XYZ robotic dispensing machine that is pre-programmed to dispense an exact, pre-determined pattern, and in a pre-determined thickness, at the location were the new print head is to be installed.

The new print head assembly contains three major elements: (a) the print head; (b) the flexible board; and, (c) the contacts. The print head is the component or part that directly dispenses the ink on the printed media by the use of electrical pulses that activate microscopic chambers that fire up the ink drop, as explained below in greater detail. The contacts engage with electrical contacts that are typically found in the shape of spring loaded pins inside the cradle that holds the inkjet cartridge in the inkjet printer. Those pins transfer or provide conduits or paths for the electrical pulses to travel to the print head firing chambers located in the new print head. The print head and the contacts are embedded on the flexible board. The flexible board contains the electrical strings, wires or traces that electrically connect the print head to the contacts.

Installing the New Print Head

Second is a process of installing the new print head by accurately placing the new print head over the dispensed adhesive and at the precisely predetermined position. Placement of the print head is accomplished by use of a placement machine that in turn uses one or more vacuum suction cups to hold and then position the print head assembly at the predetermined position. Through use of a robotic arm, the printing head is placed on top of the freshly dispensed adhesive and at the exact, pre-determined location.

Curing the Adhesive

Next the adhesive is cured, preferably in a conveyor oven or convection oven at a temperature in the range of about room temperature to about 80 degrees C. for at time in the ranged of about 10 minutes to about 2 hours. The presently most preferred temperatures are in the range of about 60 degrees C. to about 80 degrees C. and for about 30 minutes.

Adhesion of the contact area of the print head assembly to the old, used inkjet cartridge housing is done by a placing robot that uses one or more vacuum suction cups to hold and release the print head assembly. The contacts areas are pressed and heated against the inkjet cartridge housing. That process activates the hot melt adhesive coated on the back side of the new print head assembly and by doing so, fixes the contact area of the print head assembly to the used print head cartridge. Alternatively, this process could be accomplished by pre-heating the used cartridge housing and then applying pressure to affix the contact area of the print head assembly.

Electrical Testing

The print head assembly is then electrically tested in order to assure the functionality of the cartridge print head assembly.

Sealing

The print head is then sealed using a conventional sealing tape and the cartridge is filled with ink, preferably under vacuum conditions in order to assure degassing of the ink and removal of microscopic air bubbles that have been entrapped inside the firing chambers.

Labeling

The cartridge is then labeled and packaged and protected to prevent leaking of the cartridge in transit.

These and other embodiments, features, aspects, and advantages of the inventive process will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein.

DETAILED DESCRIPTION

Figure 1:
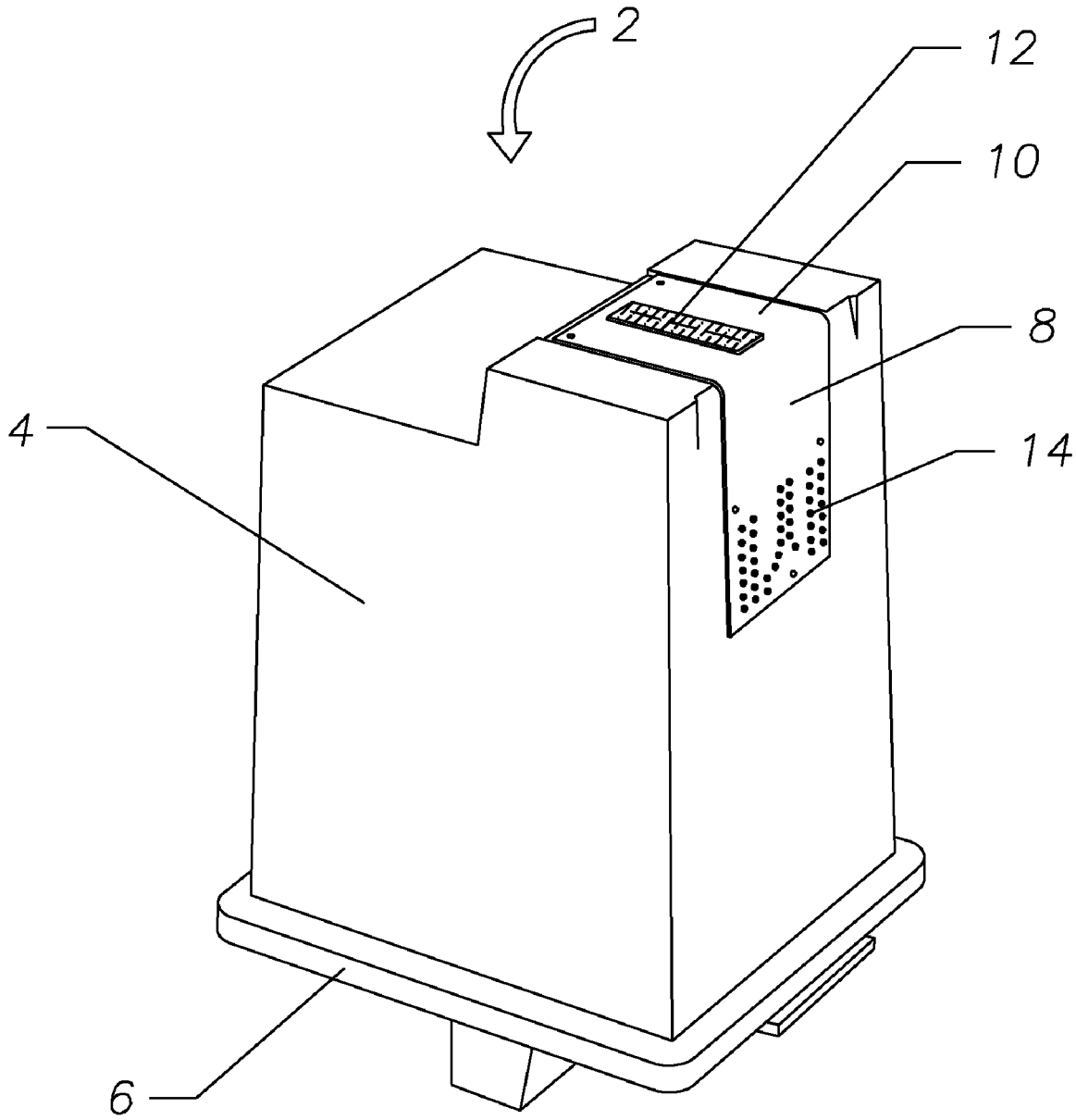
FIG. 1 is a perspective, bottom view of a used inkjet printer cartridge assembly containing a used cartridge housing and a used print head assembly.

With reference to the above-identified drawings, preferred embodiments of the inventive system and process will be described. Referring to FIG. 1, used inkjet printer cartridge 2, having a plastic housing 4, a cap 6, a print head assembly 8 containing a flexible board 10 that is electrically integrated with the print head 12, and electrical contacts 14 that engage the contacts inside the cradle of the printer are shown.

Figure 2:
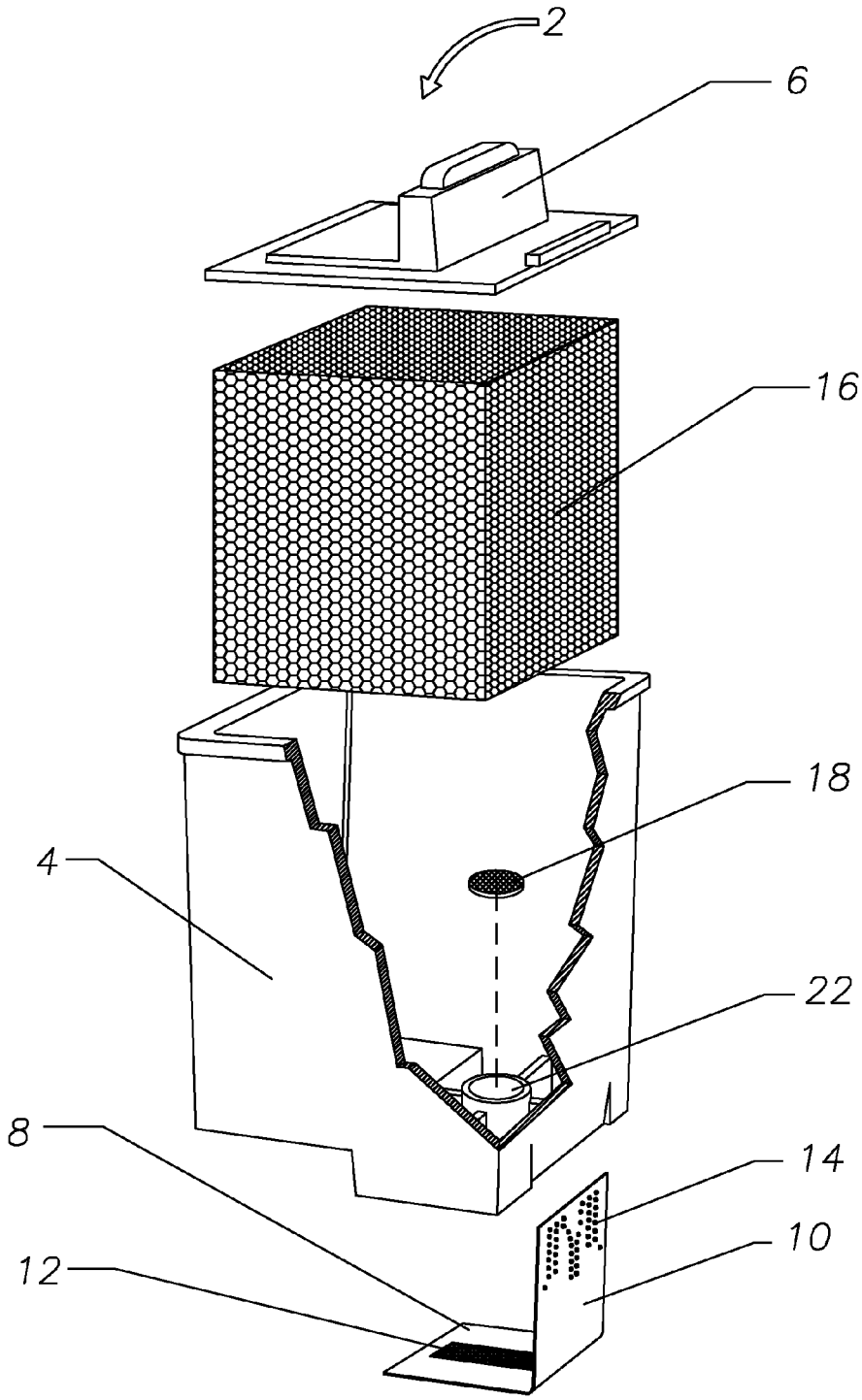
FIG. 2 is an exploded perspective view of the FIG. 1 cartridge housing assembly.

As shown in FIG. 2, the used inkjet cartridge 2 includes housing 4, cap and foam 16. The foam 16 contains ink, and ink filter 18 prevents contaminants and relatively large ink particles from penetrating through the print head 12 and through the ink delivery tunnel 22. The tunnel 22 is also referred to as the "chimney". Print head assembly 8, flexible board 10, print head 12 and the electrical contacts 14 are also shown.

Figure 3:
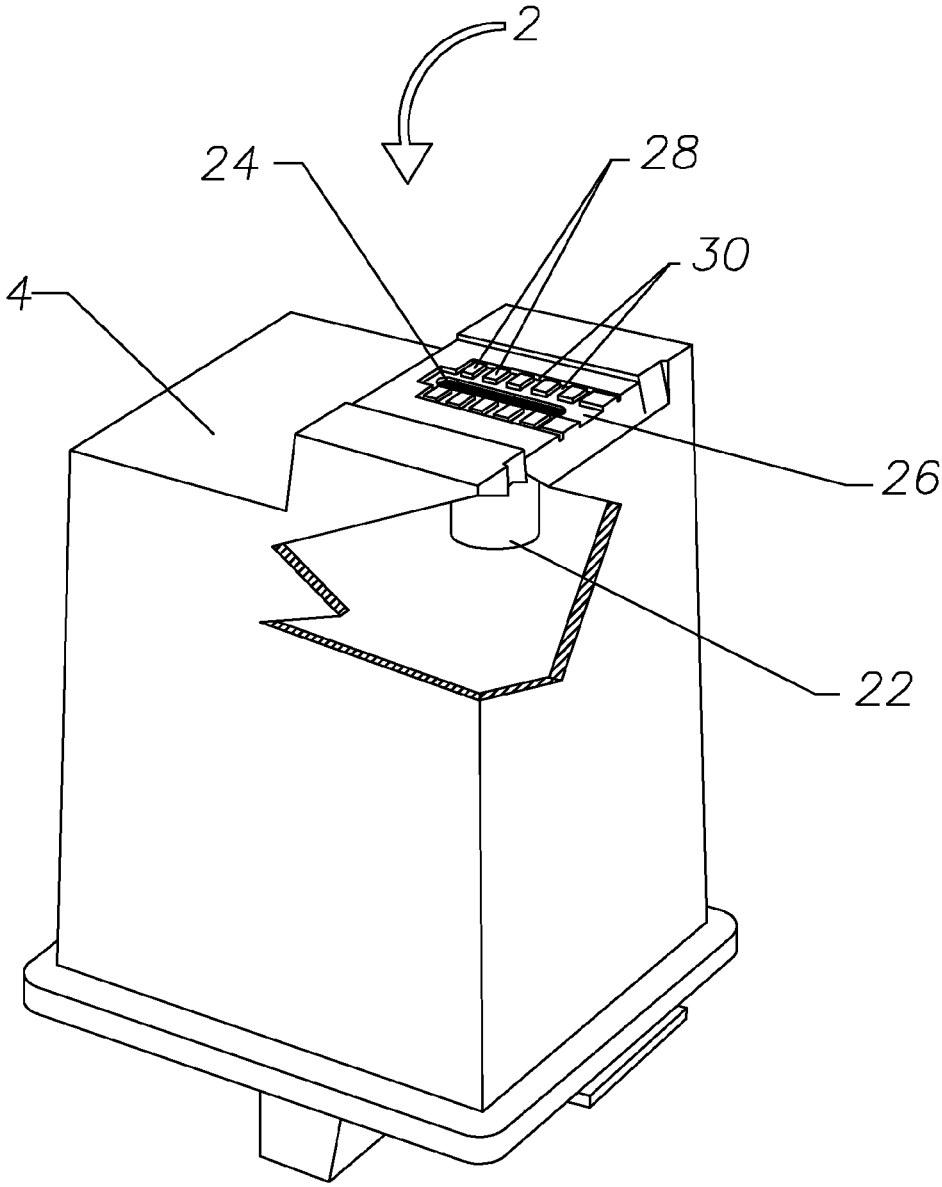
FIG. 3 is a perspective bottom view of the prior art cartridge housing assembly.

With reference to FIG. 3, the used inkjet cartridge 2, housing 4, delivery tunnel o chimney 22 and cartridge ink delivery duct 24 are shown. It is believed that the adhesive is dispensed around the cartridge ink delivery duct 24 over the surface 26 and once the print head is placed, not shown, it is believed that the adhesive residues on surface 26 are pushed to adhesive run out tunnels or channels 28 and 30 in order to prevent contamination of adhesive in the ink delivery duct 24.

Figure 4:
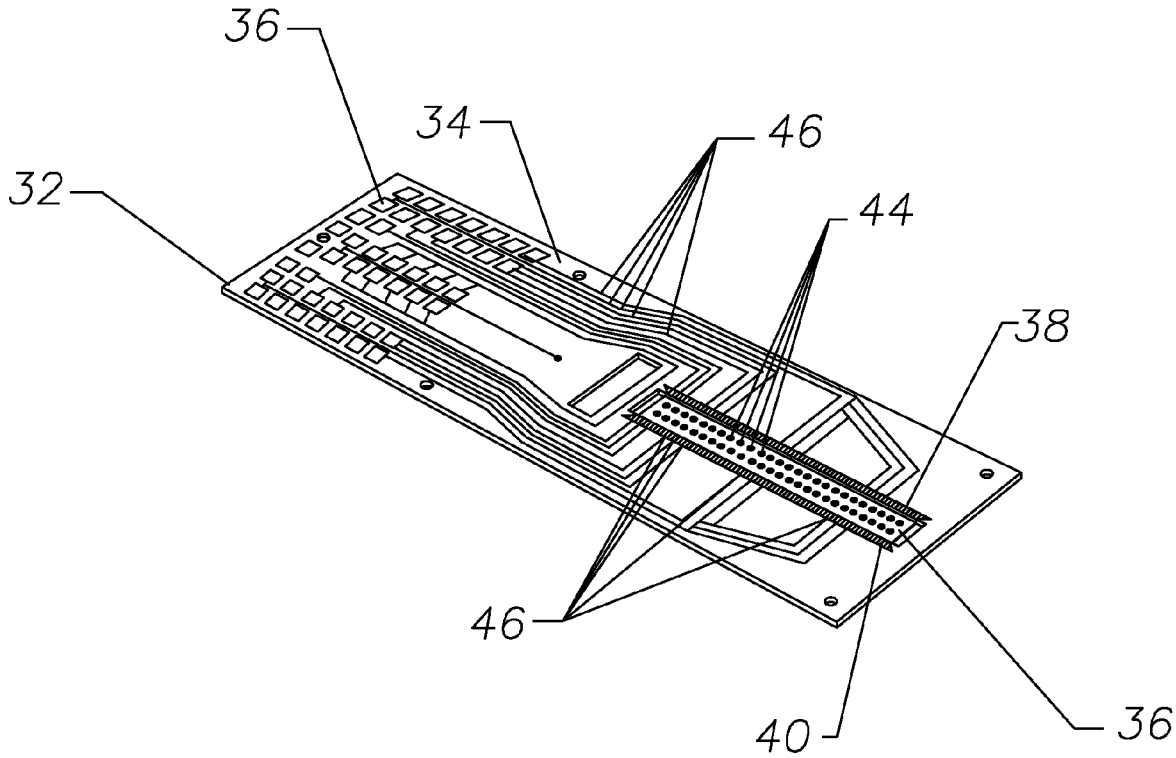
FIG. 4 is a perspective outside view of the FIG. 1 print-head assembly.

As shown in FIG. 4, new print head assembly 32 contains flexible board 34 and electrical contacts 36. These contacts engage with corresponding contacts located inside the printer cradle, not shown, to form a complete electrical circuit that controls and enables printing. Also shown are nozzle plate 36 and adhesive beads 38 and 40. Nozzle plate 36 dispenses the ink directly onto the printed media through the microscopic nozzles 44. Electrical wires 46 are in electrical communication with the print head chambers, not shown, and with the electrical contacts 36.

Figure 5:
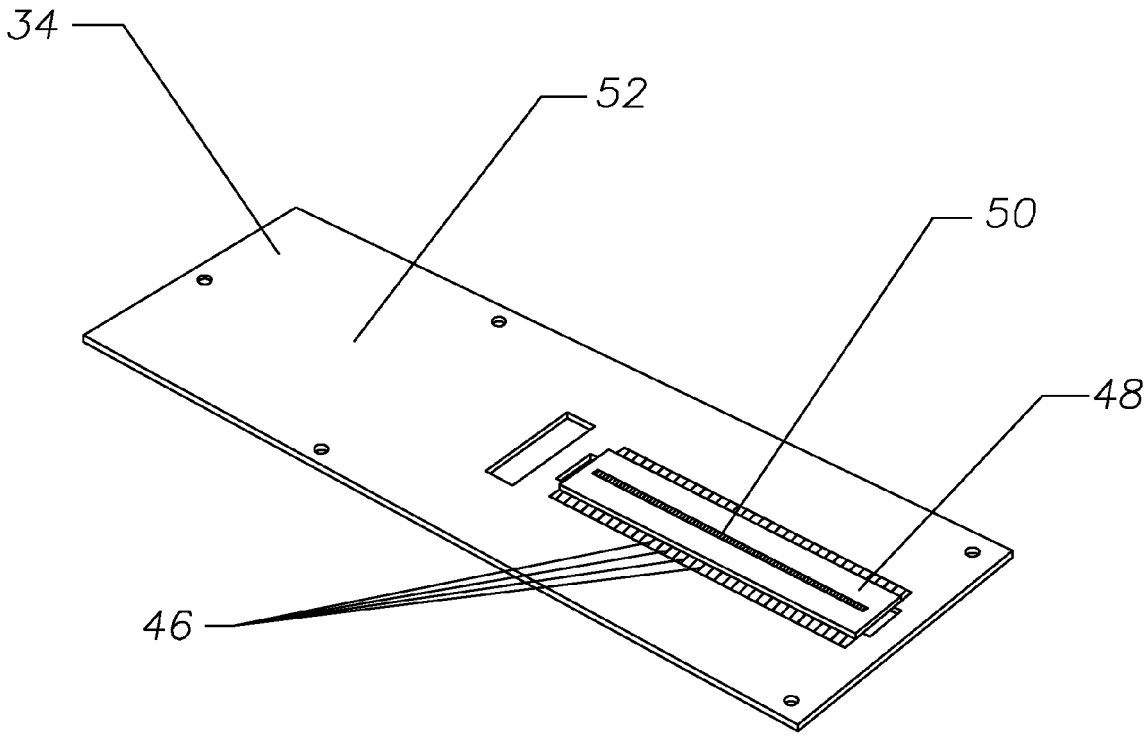
FIG. 5 is a perspective inside view of the FIG. 1 print-head assembly.

With reference to FIG. 5, an inside view of new print head assembly 34 is show. Print head 48, print head ink delivery duct 50, electrical wires 46 and hot melt adhesive film 52 are shown. The adhesive film 52 functions to adhere the print head assembly to the cartridge housing with application of pressure and heat.

A preferred process of removing the used print head and removing the used print head adhesive from the prior art cartridge housing 4 by means of routing is described with reference to FIG. 6. The flexible board with the contacts is first removed using heat and pointed pliers. Typically the original print head has been adhered to the housing with a strong thermosetting adhesive that creates a bond that cannot be broken by the use of heat alone. Therefore when removing the used flexible board from the housing, the used print head 12 typically detaches from the flexible board and stays bonded to the cartridge. In order to remove the used print head, a routing CNC machine is used with an appropriate routing bit 53 that is rotated at relatively high speed, for example several thousand rpm, in the direction of the arrow 56 and progresses linearly in the direction of arrow 57 to remove the used print head 12 and the used adhesive 58 that remains on adhesive surface 26, as shown in FIG. 3. A new, clean surface 60 is formed by the routing process to form a surface upon which new adhesive is dispensed. Holding fixture 62 is adapted to retain swivel locking bar 64. The locking bar 64 is adapted to swivels in the direction of arrow 66, and, once locked by pin 68, the fixture 62 keeps the cartridge stable during the routing process.

Figure 7:
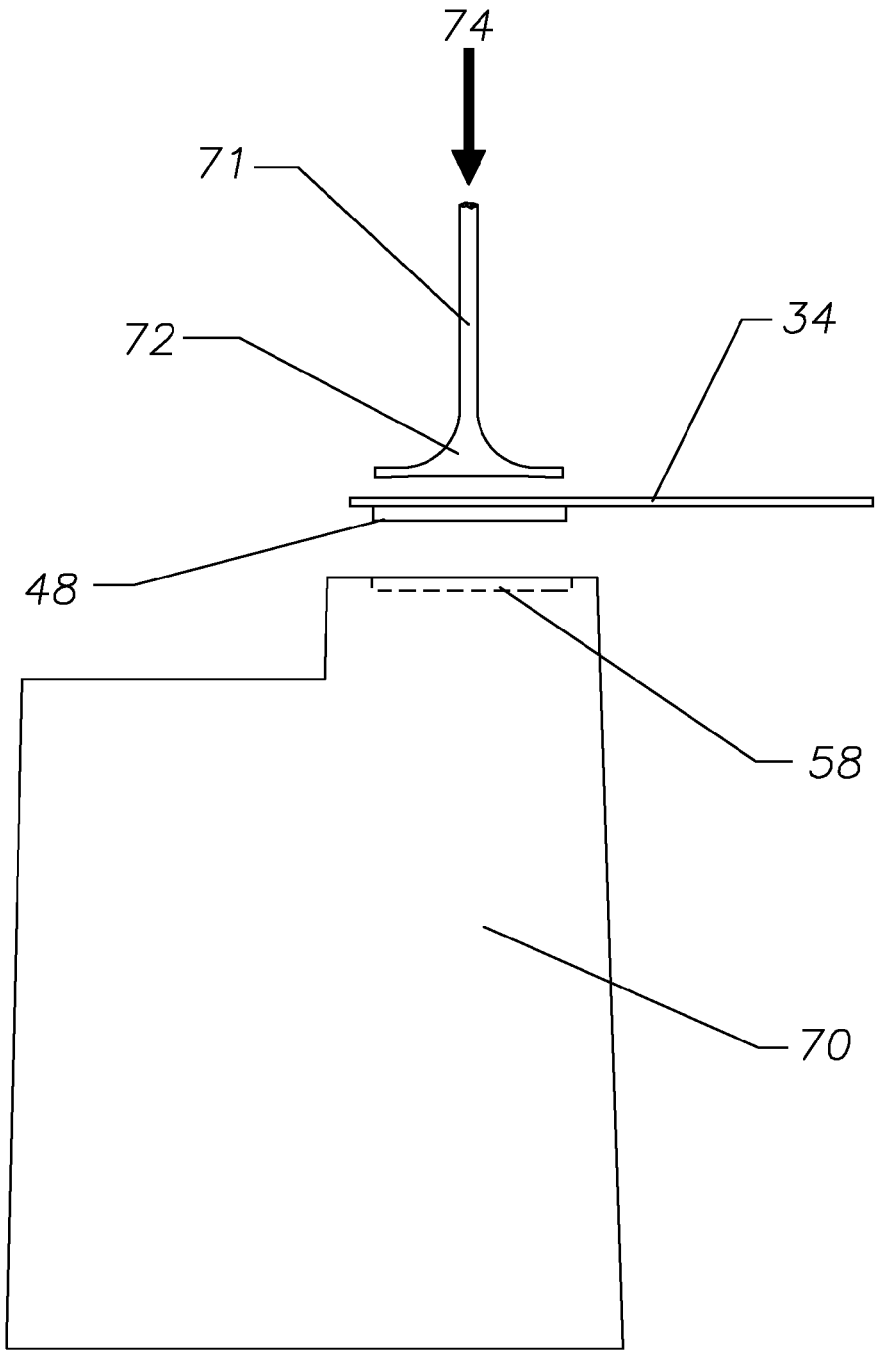
FIG. 7 is a schematic drawing of a preferred process of placing a new print head assembly over the FIG. 1 used cartridge housing; and, FIG. 8 is a schematic drawing showing affixation of the contact area of the new print head assembly onto the FIG. 1 cartridge housing.

As shown in FIG. 7 the print head area of the new print head assembly 34 is installed over, that is, on the modified cartridge housing 70. New print head 48 is pressed on top of the dispensed adhesive, not shown, at the desired or pre-determined position, and over the newly routed surface 60. Robotic arm 71, equipped with suction cup 72 that holds the print head, moves the print head in the direction of arrow 74 and into the desired, predetermined position. Once the print head is in place, the vacuum on suction cup 72 is released and the arm 71 moves back to its original position and in the opposite direction of arrow 74.

Figure 8:
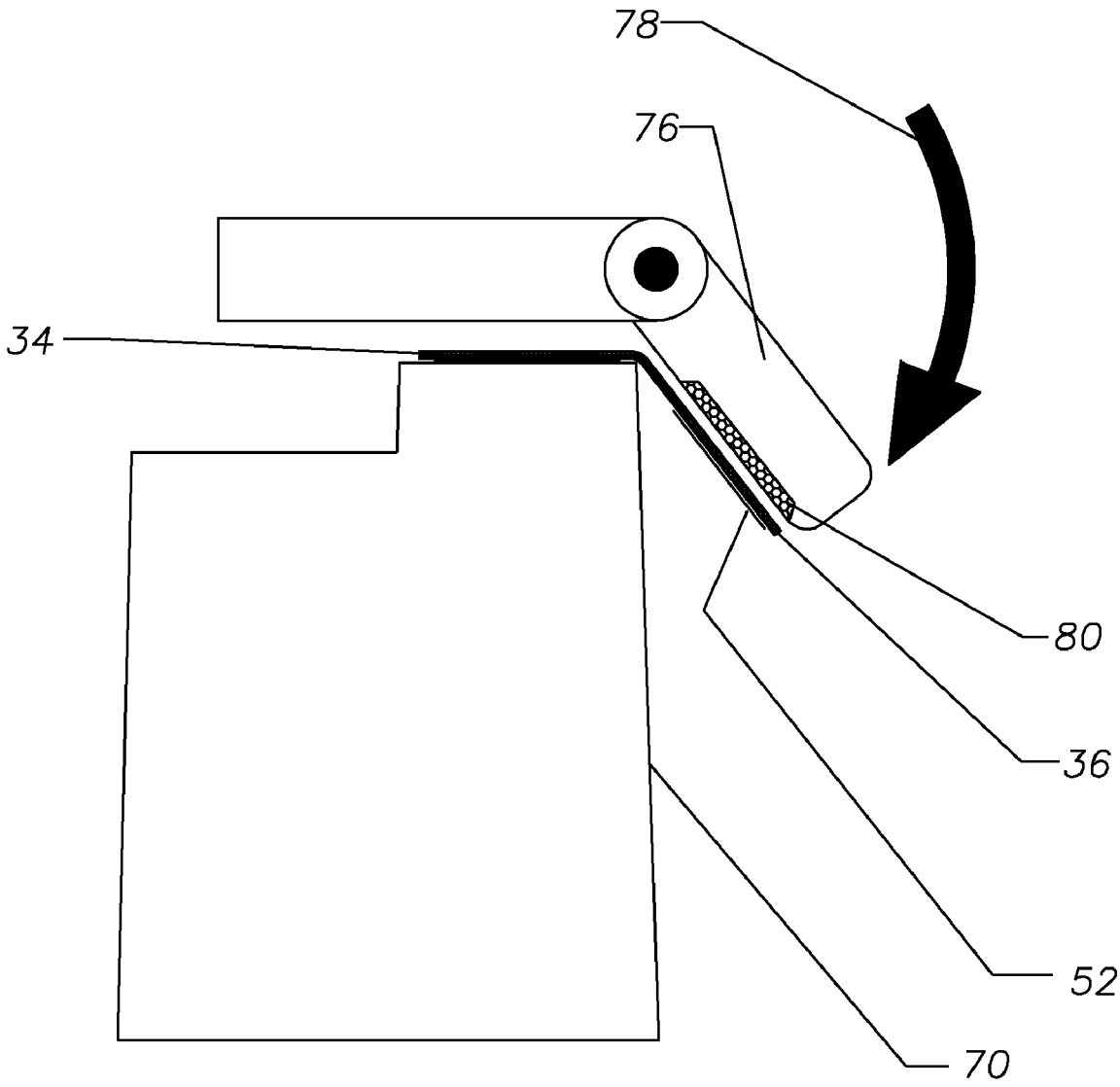

Referring to FIG. 8, the contact area 36 of the new print head assembly 34 is installed by swivel robotic arm 76 that swivels in the direction of arrow 78 and pushes the print head assembly contact area 36 over the modified cartridge housing 70. Heating pad 80 then generates heat and in combination with arm 76, pressure is generated sufficient to activate the hot melt adhesive film 52 that then adheres the print head to the cartridge housing 70.

Preferred Operation of the Print Head Replacement System

While the present system and process is directed to aspects of remanufacturing a cartridge, a description of the operation of a conventional inkjet printer cartridge, print-head and the process of making the print head is found in U.S. Pat. No. 6,293,664 and U.S. Pat. No. 6,310,641. In general, the present systems and processes relate to an inkjet cartridge print head made by thermal-jet technology or piezo-electric jet technology were the print head assembly is integrated on the ink container and not inside of the printer, separated from the ink reservoir.

A thermal jet inkjet print head operates by dispensing ink through a set of microscopic nozzles that are located over a microscopic chamber. A heating element or a resistor is installed at the bottom of the chamber that contains the inkjet ink. As the resistor receives an electrical pulse through the electrical microscopic wires it heats up. The heating element heats up for a definite period of time. The heating of the resistor causes a local evaporation of the ink in the resistor's surrounding. The built-up pressure from the evaporation process pushes the ink through the nozzle on the nozzle plate and to the outside of the chamber and then over the printed media. A print made by an inkjet printer is in reality a puzzle of thousands or even millions of microscopic drops with a volume in the range of a 1-10 Pico-liters. The ink drops are dispensed next to each other and on top of each other to create the image and its different tones. If the image is in gray scale a certain number of drops on top of each other will produce, for example, a black tone whereas fewer drops will produce a gray tone. In color imaging, the different colors and tones are generated by mixing, for example, the three basic colors: cyan, magenta and yellow to produce the entire color and tone gamut or ranged. As described in the background section herein, the majority of the defects or problems occurring during remanufacturing of an inkjet cartridges are caused by problems related to the print head assembly or the print head itself. In order to significantly reduce the fallout or failure rate in remanufacturing inkjet cartridges, preferred systems and processes for replacing the used print head assembly have been developed.

Preparation

Preparation preferably includes removing the used cap in order to reach the internal components of the cartridges, such as the foam and the filter. In some occasions the cartridge cannot be refilled without removing the cap. The cap can be removed by any conventional means such as cutting, splitting or popping using pressure on both sides of the cartridges housing.

Once the cap is removed, the foam is taken out for washing or re-washing. The foam can be used for another cycle by washing and drying it or it is possible as well to replace the used foam with a new foam. After the foam is removed, the filter is removed as well. Removing the filter is not a necessity but is preferably because such removal can reduce the time it takes to wash the cartridge housing, especially in the ducting areas 22, 24 as shown in FIG. 3, below the ink filter 18, as shown in FIG. 2, and above the print head 12, as shown in FIG. 1. Often times, the used ink dries up inside the ducting area and cannot be cleaned out without removing the filter, especially when dealing with pigmented ink systems.

After removing the filter, the print head assembly is preferably put in an oven at 100-140 degrees F. for 5-30 minutes in order to loosen the adhesion between the hot melt adhesive on the original flexible board and the cartridge housing. The cartridge is taken out of the oven and the flexible board, including the contacts, is removed using a spatula or a similar tool. The print head then tears from the flexible board but remains attached to the cartridge housing because the prior art adhesive is a thermosetting polymer that doesn't change is viscosity once heated to those temperatures.

In order to remove the print head and the adhesive the original print head is preferably removed by a router in combination with a CNC machine. Accurate removal of the print head and adhesive is an advantageous feature of the present system and methods, whereby a new mounting surface 60 is created, as shown in FIG. 6, for the new print head and new adhesive. The most preferred accuracy in regard to this aspect of the process is 0.001 to 0.005 inch. The pre-programmed CNC routing machine cuts out the prior art print head 12, as shown in FIG. 1, and the used adhesive as shown in and described with reference to FIG. 6.

Once all components of the prior art print head assembly are removed, the cartridge is washed and dried. This process can be done by any washing means such as manually washing under a sink, in a conveyor washing machine or a tray with water spray. The drying process can be done using a convection oven, blowing air or a conveyor oven. The cartridge housing is preferably completely dry before the installation of the adhesive is conducted in order to assure that there is no moisture inside or outside of the cartridge housing that can later affect the bond quality.

A new filter is then preferably installed with a soldering iron having substantially the same shape and dimensions of the chimney. The filter is placed, preferably with a pneumatic machine that applies the filter with an aligning fixture and affixes the filter on top of the chimney using heat and pressure for a predetermined of time sufficient to achieve a sturdy assembly.

Once the filter is installed, the process of installing the print head assembly takes place, as shown in FIGS. 7 and 8. The process includes dispensing the print head adhesive, placing the print head area of the new print head assembly over the modified housing, and placing the contact area of the new print head assembly over the modified housing.

Figure 6:
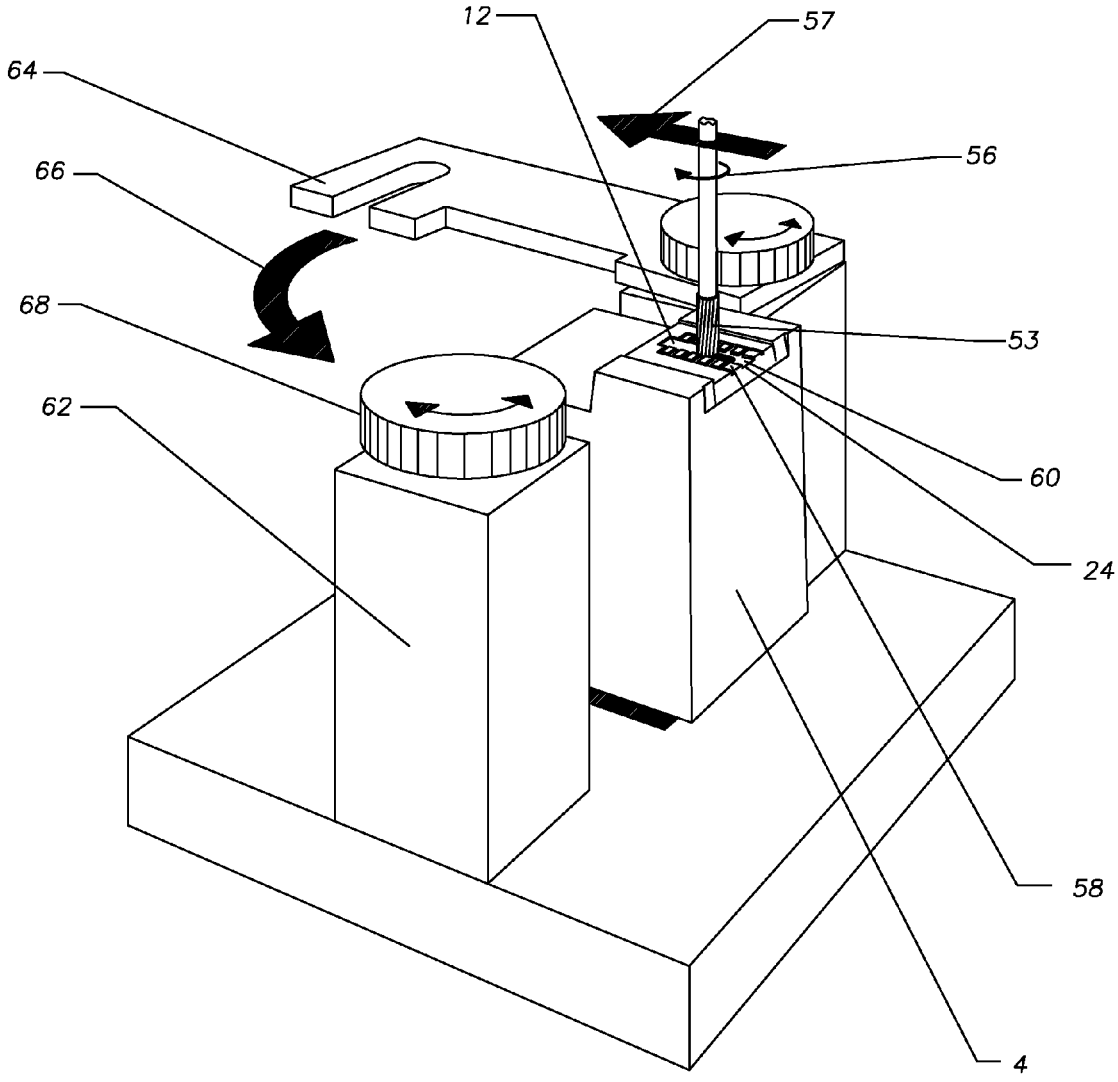
FIG. 6 is a perspective view showing a preferred routing process for removing the FIG. 1 print head assembly from the used cartridge housing.

Next, the adhesive is applied with a conventional, automatic, preprogrammed XYZ robotic dispenser that uses a computer controlled dispensing mechanism that applies the adhesive on the newly made adhesive surface 60, as shown in FIG. 6. The adhesive is applied around the cartridge ink delivery duct 24. Preferably the adhesive is a dual component epoxy system, chosen to achieve good dimensional stability, great bond strength and high resistance to humidity and water. Other types of adhesive systems can be used so long as they function to achieve the above properties and meet the above criteria.

A preferred print head side installation is shown in and described above with respect to FIG. 7. The print head assembly preferably is aligned using a fixture that holds the print head assembly and applies it using a pneumatic arm to that that print head is positioned at the exact, pre-determined location on the newly routed surface 60 as shown in FIG. 6.

The system is then heat cured in order to prevent disconnection of the print head assembly from the cartridge housing.

Next the contact area of the new print head assembly preferably is affixed to the cartridge housing as can be seen in FIG. 8. The head assembly is bent over the cartridge housing. Then heat and pressure are applied sufficient to activate the hot melt layer on the inner side of the print head assembly. The specific heat and pressure required are specific to the adhesive used, as will be appreciated by a person skilled in this field.

Once the print head assembly is installed, the cartridge is then electrically tested for any malfunction in the print head assembly due to the installation process.

Once the cartridge assembly passed the electrical test, the foam is inserted and the cartridge is filled with ink.

Once the cartridge is filled with ink, a new cap or the used cap is installed or re-installed, preferably by means of ultrasonic welding as described in U.S. Pat. No. 6,773,087.

Finally, the cartridge may be tested in order to assure the print quality or the cartridge could be packed for shipping without further testing.

Although specific embodiments of the invention have been described, various modifications, alterations, alternative constructions, and equivalents are also encompassed within the scope of the invention. The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A process for remanufacturing a spent inkjet printer cartridge having a housing, a print head, a flexible board having electrical contacts and adhesive, a filter, a foam and a cap comprising:

removing the cap;

removing the foam;

removing ink from inside of the housing;

heating the spent cartridge sufficient to loosen adhesive between the flexible board and the cartridge housing;

removing the flexible board from the housing to expose the print head;

removing the print head and adhesive by routing the print head and adhesive to cut out the print head and adhesive and to create a new print head mounting surface on the housing;

washing the housing after the print head and adhesive have been cut out;

drying the housing after washing the housing;

installing a new filter on the housing after drying the housing;

applying new adhesive onto the new print head mounting surface;

placing a new print head assembly over the new print head mounting surface; and, pressing the new print head assembly onto the new print head mounting surface at a predetermined location.

2. The process of claim 1, further including washing the foam prior to re-assembling the cartridge.

3. The process of claim 1, further including removing the filter prior to removing ink from inside of the housing.

4. The process of claim 1, further including curing the adhesive after pressing the new print head assembly onto the new print head mounting surface.

5. The process of claim 1, further including bending the new print head over an edge of the cartridge housing after pressing the new print head assembly onto the new print head mounting surface.

6. The process of claim 1, further including applying heat and pressure to the new print head assembly after pressing the new print head assembly onto the new print head mounting surface, said heat and pressure sufficient to activate said new adhesive.

7. The process of claim 1, further including curing said new adhesive.

8. The process of claim 7, further including electrically testing the cartridge after curing said new adhesive.

9. The process of claim 8, further including inserting a new foam or a washed used foam into the cartridge after electrically testing the cartridge.

10. The process of claim 1, further including installing a cap on the housing and over the new print head assembly after pressing the new print head assembly onto the new print head mounting surface.

11. The process of claim 10 wherein installing the cap is by ultrasonic welding.

12. The process of claim 1, wherein applying new adhesive onto the new print head mounting surface includes applying a two-component, epoxy amine or acrylic based adhesive.

13. The process of claim 1, wherein applying new adhesive onto the new print head mounting surface includes dispensing said adhesive with a robotic dispensing machine.

14. A remanufactured inkjet printer cartridge having a housing, a print head, a flexible board having electrical contacts and adhesive, a filter, a foam and a cap comprising:

a new print head mounting surface formed on said housing and under a used cartridge print head mounting surface;

a new print head assembly adhered to said new print head mounting surface; and, new adhesive adhering said new print head assembly to said new print head mounting surface.

15. The remanufactured inkjet printer cartridge of claim 14 wherein said new adhesive is a two-component, epoxy amine or acrylic based adhesive.

16. A system for remanufacturing a used inkjet printer cartridge having a housing, a used print head and adhesive bonding said used print head to said housing comprising:

a fixture adapted to hold said used inkjet printer cartridge in a fixed position;

the fixture including a swivel locking bar adapted to releasable lock said used cartridge in the fixed position;

a computer-controlled router adapted and positioned to cut out of said used cartridge said used print head and said adhesive bonding said used print head to said housing to form a new print head assembly mounting surface;

a robotic arm including at least one suction cup and adapted to place a new print head assembly over said new print head assembly mounting surface; and, a swivel robotic arm adapted to push a portion of said new print head assembly over an edge of said new print head assembly mounting surface.

* * * * *